US006843736B2

(12) United States Patent
Kasashima

(10) Patent No.: US 6,843,736 B2
(45) Date of Patent: Jan. 18, 2005

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/663,702

(22) Filed: Sep. 17, 2003

(65) Prior Publication Data

US 2004/0058752 A1 Mar. 25, 2004

(30) Foreign Application Priority Data

Sep. 25, 2002 (JP) ..... 2002-279405

(51) Int. Cl.[7] ..... A63B 37/12
(52) U.S. Cl. ..... 473/383
(58) Field of Search ..... 473/378–385

(56) References Cited

U.S. PATENT DOCUMENTS

| | | | | | |
|---|---|---|---|---|---|
| 4,830,378 | A | * | 5/1989 | Aoyama | 473/384 |
| 5,060,954 | A | | 10/1991 | Gobush | |
| 5,377,989 | A | | 1/1995 | Machin | |
| 6,290,615 | B1 | | 9/2001 | Ogg | |
| 6,471,605 | B2 | * | 10/2002 | Ogg | 473/383 |
| 6,595,876 | B2 | | 7/2003 | Kasashima et al. | |
| 2003/0158002 | A1 | * | 8/2003 | Morgan et al. | 473/383 |

* cited by examiner

*Primary Examiner*—Raeann Gorden
(74) *Attorney, Agent, or Firm*—Sughrue Mion, PLLC

(57) ABSTRACT

In a golf ball, triangular dimples each defined by combining three ridge-like lands having a side length of 2–9 mm are arranged on the spherical surface. The percent occupation of the total dimple area over the entire spherical surface area is significantly increased, even to substantially 100%, and the ball is drastically improved in flight performance.

14 Claims, 5 Drawing Sheets

GOLF BALL

TECHNICAL FIELD

This invention relates to golf balls having improved flight performance.

BACKGROUND ART

As is well known in the art, in order for a golf ball to travel a distance when launched, the rebound properties of the ball itself and the sophisticated arrangement of dimples on the ball surface to reduce the air resistance of the ball in flight are important. To reduce the air resistance, many methods of uniformly arranging dimples over the entire ball surface at a higher density have been proposed.

Most often, dimples are indentations of circular shape as viewed in plane. To arrange such circular dimples at a high density, it will be effective to reduce the width of a land partitioning two adjoining dimples to nearly zero. However, the region surrounded by three or four circular dimples becomes a land of generally triangular or quadrangular shape having a certain area. On the other hand, it is requisite to arrange dimples on the spherical surface as uniformly as possible. Thus the arrangement density of circular dimples must find a compromise.

Under the circumstances, Kasashima et al., U.S. Pat. No. 6,595,876 attains the purpose of uniformly arranging dimples on a golf ball at a high density, by arranging dimples of 2 to 5 types having different diameters on the spherical surface of the ball which is assumed to be a regular octahedron or icosahedron.

However, as long as circular dimples are used, the percent occupation of the total dimple area over the entire spherical surface area encounters a practical upper limit of approximately 75% (or the percent occupation of the total land area is approximately 25%). In order to further reduce the air resistance of a ball in flight, it would be desirable if the dimples arranged on the ball surface are devised so as to increase the percent occupation of the total dimple area over the entire spherical surface area.

SUMMARY OF THE INVENTION

An object of the invention is to provide a golf ball which is improved in flight performance by increasing the percent occupation of the total dimple area over the entire spherical surface area.

It has been discovered that when dimples of triangular shape are defined by combining ridge-like lands, the proportion of lands on the spherical surface is significantly reduced and the lands are uniformly arranged.

According to the present invention, there is provided a golf ball comprising on its spherical surface triangular dimples each defined by combining ridge-like lands having a side length of 2 to 9 mm.

In a preferred embodiment, the triangular dimples are arranged throughout the spherical surface.

The golf ball has an axis connecting opposite poles and an equator with respect to the opposite poles, by which the spherical surface is divided into hemispherical surface sections. In a preferred embodiment, twelve pentagons each defined by combining five triangular dimples are axisymmetrically arranged about the axis, and hexagons each defined by combining six triangular dimples are arranged in the remaining area of the spherical surface. More preferably, six pentagons are arranged on each hemispherical surface section.

In another preferred embodiment, provided that N is the total number of apexes of the triangular dimples, which is in a range of 150 to 450, the number of the triangular dimples is 2N−4.

In a further preferred embodiment, quadrangular dimples each defined by combining ridge-like lands are further included. The total number of apexes of the triangular and quadrangular dimples is preferably in a range of 150 to 450, and more preferably in a range of 150 to 350.

Each dimple may have either a concave bottom, a flat bottom, or a convex bottom which is concentric with the spherical surface of an imaginary dimple-free ball.

Typically, the dimples have a maximum depth of less than 0.5 mm, more preferably 0.1 mm to 0.4 mm; and the ridge-like lands have a width of 0 to 1.0 mm at the top.

The golf ball of the invention having on its surface dimples of triangular shape defined by combining a plurality of ridge-like lands has the advantage that assuming that an imaginary spherical surface circumscribes the top of lands, the percent occupation of the total land area over the entire imaginary spherical surface area can be reduced to nearly zero. At the same time, the dimples can be arranged on the golf ball surface as uniformly as possible.

In the golf ball of the invention, triangular dimples each defined by combining ridge-like lands having a side length of 2 to 9 mm are arranged on at least a portion of the spherical surface while dimples of different shape may be arranged in the remaining area of the spherical surface. Such different shape dimples are of polygonal shape such as tetragonal, pentagonal or hexagonal shape, but not limited thereto. For the dimples to be arranged in the remaining area of the spherical surface, any desired ones may be chosen without any limit on the size and shape of dimple-defining lands and insofar as the objects of the invention are not impaired. However, it is desired that the height of lands (or the maximum depth of dimples) be equal throughout the entire golf ball surface.

DESCRIPTION OF THE PREFERRED EMBODIMENTS

Figure 1:
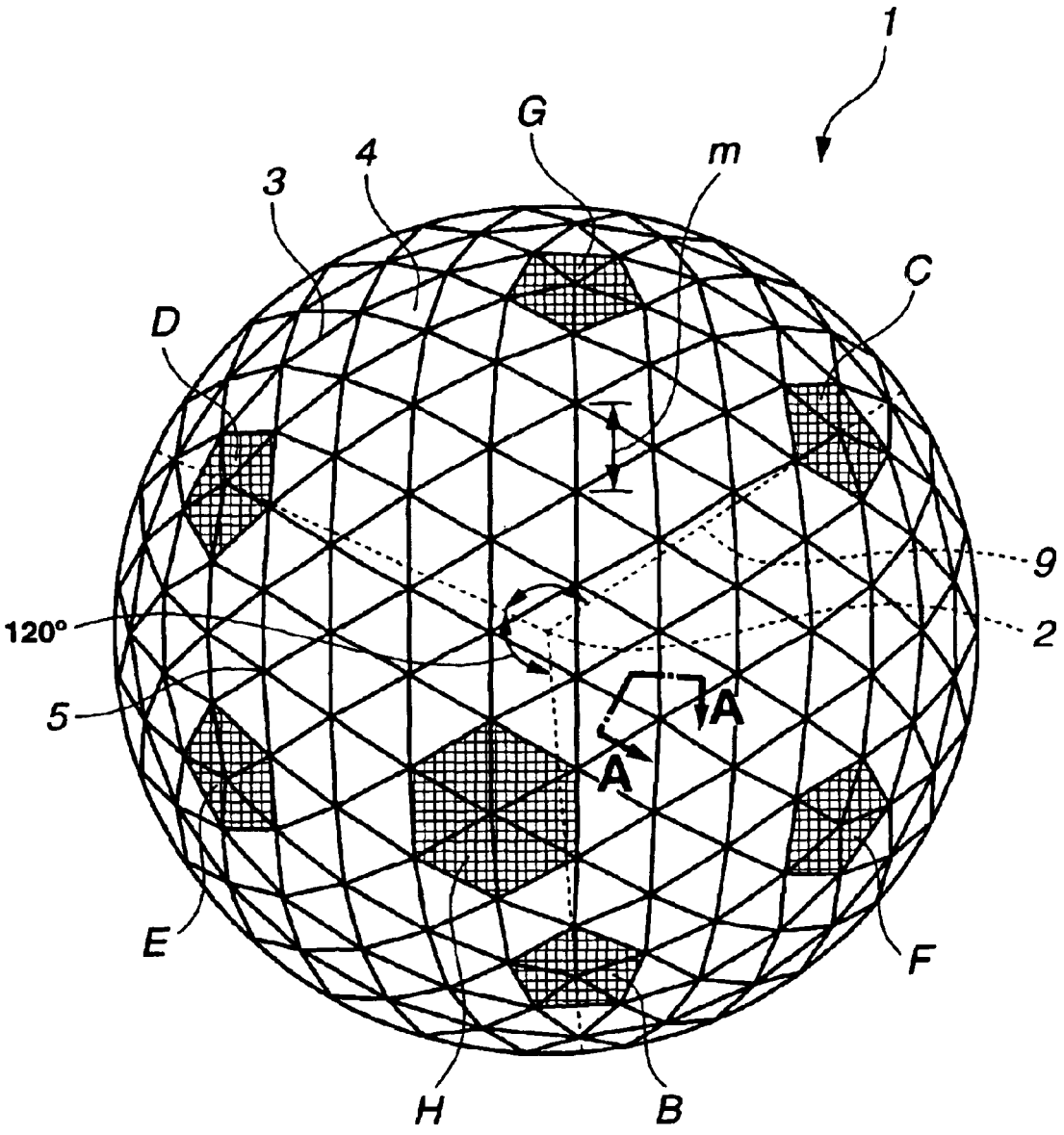
FIG. 1 is a plan view of a golf ball according to a first embodiment of the invention.
Figure 2:
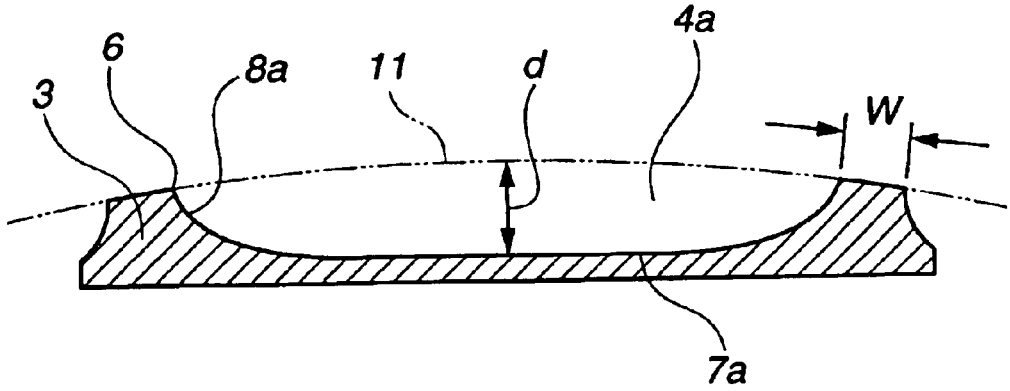
FIG. 2 is a cross-sectional view taken along lines A—A in FIG. 1 of one exemplary dimple on the inventive golf ball.

Referring to FIG. 1, a golf ball 1 according to a first embodiment of the invention is illustrated in a plan view. FIG. 2 is a cross-sectional view of a dimple taken along lines A—A in FIG. 1. It is noted that the golf ball has a spherical surface 11, a center, opposite poles one of which is designated at 2, an axis connecting the poles, and an equator; and that the cross-section of the dimple in FIG. 2 appears in a radial plane with respect to the ball center.

In the first embodiment, dimples 4 of triangular shape each defined by combining three ridge-like lands 3 having a side length "m" are arranged throughout the spherical surface. The ridge-like lands 3 defining each dimple are depicted by solid lines (the same applies to second and third embodiments of FIGS. 5 and 6 to be described later).

The length "m" of the ridge-like lands is generally at least 2 mm, preferably at least 3 mm, more preferably at least 4 mm, and its upper limit is generally up to 9 mm, preferably up to 8 mm, more preferably up to 7 mm. If the length "m" of land is excessive, the dimple arrangement may be unbalanced. If the length is too small, dimples may exert least the aerodynamic effect.

FIG. 2 illustrates the cross-sectional shape of a dimple. The dimple includes a side wall 8*a* and a bottom 7*a*. The side wall 8*a* intersects with the top of a land 3 to define an edge 6. The dimple shown in FIG. 2 has a concave cross-sectional shape that increases its depth from the edge 6 and reaches the maximum depth at the center of the bottom 7*a*. The maximum depth depicted at "d" is generally at least 0.1 mm, preferably at least 0.15 mm, and its upper limit is generally less than 0.5 mm, preferably up to 0.4 mm. If the depth "d" of dimple is excessive, the air resistance may increase. If the depth is too small, the effect of dimple arrangement may degrade.

It is understood that the depth "d" of dimple is the distance between the dimple bottom 7*a* (7*b*, 7*c*) and an imaginary spherical surface 11 which is depicted as circumscribing the top of lands 3.

The width "w" of a land at its top is generally up to 1.0 mm, preferably up to 0.5 mm and may be substantially 0 mm. If the width "w" of land is excessive, the aerodynamic effect may degrade.

Figure 3:
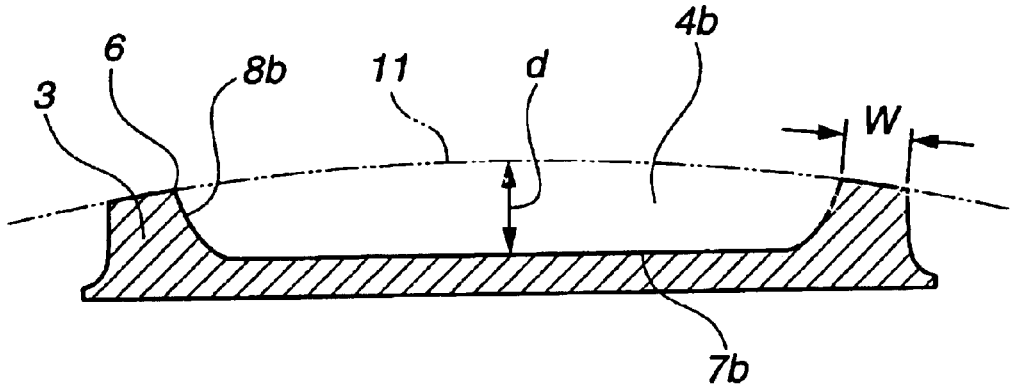
FIG. 3 is a cross-sectional view of another exemplary dimple on the inventive golf ball.
Figure 4:
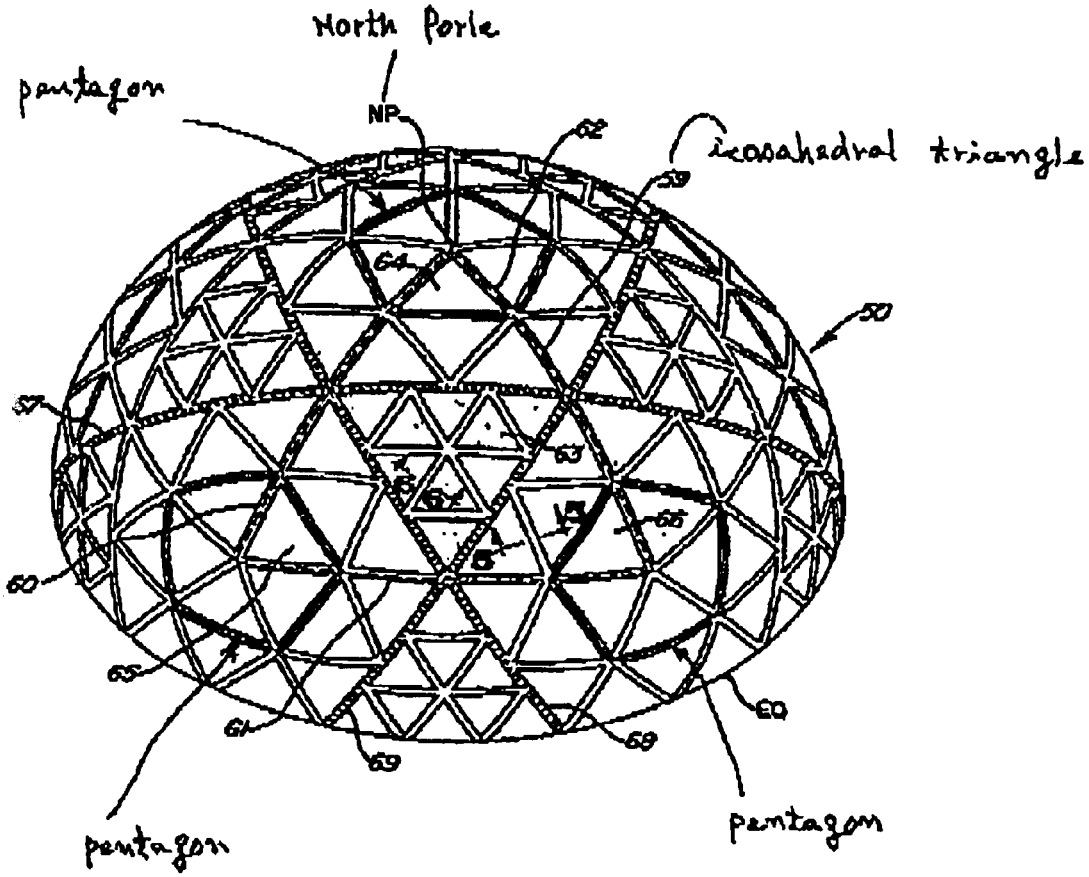
FIG. 4 is a cross-sectional view of a further exemplary dimple on the inventive golf ball.

FIGS. 3 and 4 illustrate dimples differing in bottom shape. The dimple of FIG. 3 includes a side wall 8*b* which is relatively sharply inclined from the dimple edge 6 and a flat bottom 7*b*. The dimple of FIG. 4 includes a side wall 8*c* which is relatively sharply inclined from the dimple edge 6 and a convex bottom 7*c* which is concentric with the imaginary spherical surface 11 corresponding to the spherical surface of an imaginary dimple-free ball. The convex bottom 7*c* is a portion of spherical surface. Provided that "R" is the radius of the golf ball (equal to the radius of the imaginary spherical surface 11), "r" is the radius of a spherical surface that contours the convex bottom 7*c* and is concentric with the imaginary spherical surface 11, and "d" is the depth of the dimple, they are in the relationship: $r=R-d$.

In the first embodiment, twelve pentagons each defined by combining five triangular dimples are axi-symmetrically arranged about the axis connecting opposite poles 2. Provided that the spherical ball surface is divided into hemispherical surface sections by the equator, six pentagons are arranged on each hemispherical surface section, as seen from shaded areas in FIG. 1. More particularly, first, second and third pentagons B, C and D are located on 120° spaced apart longitudes 9 and on a common latitude, while fourth, fifth and sixth pentagons E, F and G are located on 120° spaced apart longitudes and on a common latitude.

In the first embodiment, the first pentagon B, fifth pentagon F, second pentagon C, sixth pentagon G and so forth which adjoin to each other about the pole 2 are located at unequal intervals of narrow, wide, narrow, wide and so forth, although these pentagons may be located at equal intervals.

Also in the first embodiment, the first to sixth pentagons are located on a common latitude, although these pentagons may be located on spaced apart latitudes. For example, first to third pentagons of one group are located at a relatively high latitude and fourth to sixth pentagons of another group are located at a relatively low latitude.

Further in the first embodiment, hexagons H each defined by combining six triangular dimples are arranged fully in the remaining area of the spherical surface, that is, the area other than the pentagons. Hexagons are formed about all the positions where apexes 5 of triangles join together, excluding the centers of pentagons (the center being the common position of apexes of five triangular dimples). Each of five apexes of a pentagon is coincident with the center of a hexagon defined by six triangular dimples, and about that position, a hexagon which partially overlaps the pentagon is formed.

The above-described arrangement of dimples is similarly applicable to the other hemisphere divided by the equator.

In the dimple arrangement of the first embodiment, provided that N is the total number of apexes 5 of the triangular dimples, the number of the triangular dimples over the ball surface is $2N-4$. Note that the total number N of triangular apexes is counted on the premise that the common apex where apexes of five triangles join together at the center of a pentagon is one apex, and the common apex where apexes of six triangles join together at the center of a hexagon is one apex. The total number N is preferably in a range of 150 to 450, especially 150 to 350.

Figure 5:
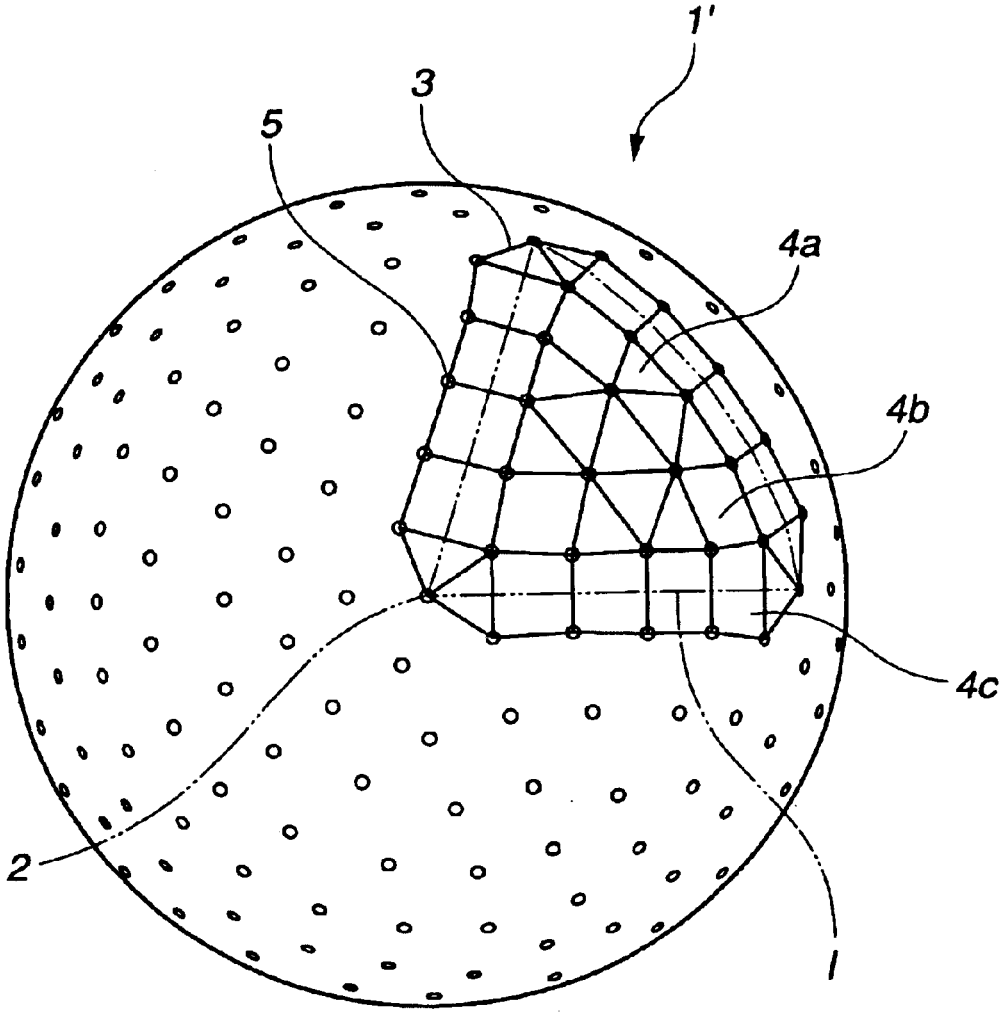
FIG. 5 is a plan view of a golf ball according to a second embodiment of the invention.

FIG. 5 is a plan view of a golf ball 1' according to the second embodiment of the invention. In the second embodiment, quadrangular dimples are included in addition to triangular dimples. The dimples are arranged on a spherical icosahedron.

In FIG. 5, a triangular unit I on the spherical icosahedron is delimited by two dot-and-dash lines extending longitudinally from the pole 2 and one latitudinally extending dot-and-dash line. For the triangular unit I, four quadrangular dimples are disposed on each side, and one triangular dimple is disposed at each end of each side. In the area inside the triangular unit I surrounded by these dimples, ten triangular dimples and three quadrangular dimples are disposed in good balance.

In FIG. 5, in the region other than the triangular unit I having the specific dimple arrangement pattern illustrated above, dimples are arranged using the same dimple arrangement pattern as that of the triangular unit I. That is, dimples are arranged in the dimple arrangement pattern of the triangular unit I over the entire ball surface. For the sake of convenience, in FIG. 5, apexes of dimples are depicted simply by small circles (○), and the depiction of dimple contours is omitted for the most part.

Figure 6:
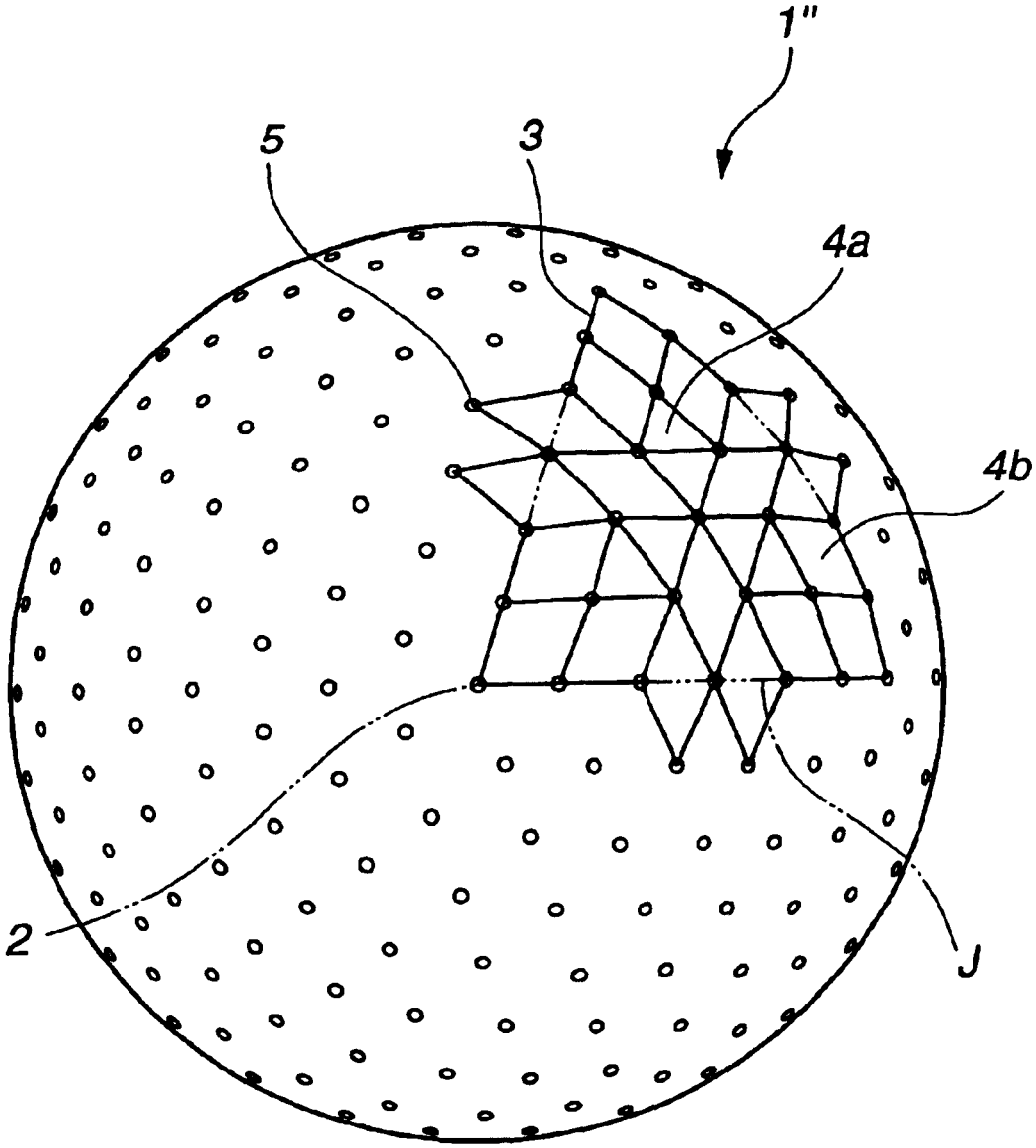
FIG. 6 is a plan view of a golf ball according to a third embodiment of the invention.

FIG. 6 is a plan view of a golf ball 1" according to the third embodiment of the invention. In the third embodiment, triangular and quadrangular dimples are arranged on a spherical icosahedron as in the second embodiment. The third embodiment of FIG. 6 differs from the second embodiment of FIG. 5 in that for a triangular unit J, a pair of combined triangular dimples are arranged in each of the directions from the center of the triangular unit J toward the three corners thereof (summing to six triangular dimples per triangular unit J), and generally rhombic (quadrangular) dimples are arranged in the remaining area within the triangular unit J. The third embodiment is also characterized in that two generally rhombic dimples are juxtaposed in a central portion of each side of the triangular unit J such that the minor one of two diagonals of a generally rhombic dimple is coincident with that side of the triangular unit J.

The total number of apexes of angular shape dimples such as triangular and quadrangular dimples (the overlapped apexes count one as previously described) is generally at least 150 and up to 450, preferably up to 350. Outside the range, the flight performance may be adversely affected.

In the golf ball of the invention, by arranging triangular dimples defined by ridge-like lands, the percent occupation of lands on an imaginary spherical surface which is depicted as circumscribing the top of lands is significantly reduced, even to substantially zero. Inversely, the percent occupation of the total dimple area over the entire spherical surface area is significantly increased, even to substantially 100%. As a consequence, the ball is drastically improved in flight performance.

Japanese Patent Application No. 2002-279405 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising on its spherical surface triangular dimples each defined by combining ridge-like lands having a side length of 2 to 9 mm, wherein the ball has an axis connecting opposite poles, twelve pentagons each defined by combining five triangular dimples are axisymmetrically arranged-about the axis, and hexagons each defined by combining six triangular dimples are arranged in the remaining area of the spherical surface.

2. The golf ball of claim 1 wherein the triangular dimples are arranged throughout the spherical surface.

3. The golf ball of claim 1 wherein the ball has an equator with respect to the opposite poles, by which the spherical surface is divided into hemispherical surface sections, and six pentagons are arranged on each hemispherical surface section.

4. The golf ball of claim 1 wherein provided that N is the total number of apexes of the triangular dimples, which is in a range of 150 to 450, the number of the triangular dimples is 2N−4.

5. The golf ball of claim 1 wherein each dimple has a concave bottom, a flat bottom, or a convex bottom which is concentric with the spherical surface of an imaginary dimple-free ball.

6. The golf ball of claim 1 wherein the dimples have a maximum depth of less than 0.5 mm.

7. The golf ball of claim 6 wherein the dimples have a maximum depth of 0.1 mm to 0.4 mm.

8. The golf ball of claim 1 wherein the ridge-like lands have a width of 0 to 1.0 mm at the top.

9. The golf ball of claim 1 wherein provided that the spherical ball surface is divided into hemispherical surface sections by the equator, six pentagons are arranged on each hemispherical surface section, wherein first, second and third pentagons are located on substantially 120° spaced apart longitudes, while fourth, fifth and sixth pentagons are located on substantially 120° spaced apart longitudes.

10. The golf ball of claim 9 wherein the first, second and third pentagons are located on substantially a first common latitude and the fourth, fifth and sixth pentagons are located on substantially a second common latitude.

11. The golf ball of claim 10 wherein the first common latitude and the second common latitude are the same latitude.

12. A golf ball comprising on its spherical surface triangular dimples each defined by combining ridge-like lands having a side length of 2 to 9 mm and quadrangular dimples each defined by combining ridge-like lands.

13. The golf ball of claim 12 wherein the total number of apexes of the triangular and quadrangular dimples is in a range of 150 to 450.

14. The golf ball of claim 13 wherein the total number of apexes of the triangular and quadrangular dimples is in a range of 150 to 350.

* * * * *